United States Patent [19]

Gaitten, deceased

[11] Patent Number: 4,516,613

[45] Date of Patent: May 14, 1985

[54] DEBARKING MACHINE WITH INFEED ROLLS HAVING HELICAL OFFSET LOG FEEDER BLADES

[75] Inventor: Walden M. Gaitten, deceased, late of Sylacauga, Ala., by Dorothy A. Gaitten, executrix

[73] Assignee: Kockums Cancar, Corp., Talladega, Ala.

[21] Appl. No.: 559,816

[22] Filed: Dec. 9, 1983

[51] Int. Cl.[3] ..... B27L 1/00

[52] U.S. Cl. ..... 144/208 E; 144/246 F; 198/624

[58] Field of Search ..... 144/208 E, 246 R, 246 C, 144/246 F; 198/624, 625

[56] References Cited

U.S. PATENT DOCUMENTS 2,897,859 8/1959 Annis, Jr. ..... 144/246 F 4,257,461 3/1981 Wangeby et al. ..... 144/246 F

*Primary Examiner*—W. D. Bray

*Attorney, Agent, or Firm*—Cushman, Darby & Cushman

[57] ABSTRACT

An improvement in a debarking machine of the type including an annular frame, a plurality of debarking tools mounted in annularly spaced relation within the annular frame for rotation together about the axis of the annular frame and for movement toward and away from each other, infeed and outfeed mechanisms for feeding logs through the annular frame so that the tools will engage the exterior periphery of the successive logs and strip the bark therefrom during their movement through the annular frame. The infeed mechanism includes three driven infeed spiked rolls arranged so that their spiked peripheries normally engage the exterior periphery of the log in centered relation and move the same axially through the annular frame for debarking by the tools. The improvement of the invention resides in providing each infeed roll with helical blades at the ends thereof for rotation therewith configured with respect to the direction of rotational movement of the associated roll to move a log engaged thereby in a lateral direction toward the spiked periphery of the roll.

7 Claims, 3 Drawing Figures

DEBARKING MACHINE WITH INFEED ROLLS HAVING HELICAL OFFSET LOG FEEDER BLADES

This invention relates to debarking machines and more particularly to improvements in debarking machines of the type described in U.S. Pat. No. 2,857,945 issued Oct. 28, 1958 to P. G. Brundell et al.

Brundell et al patent discloses an annular frame having mounted on the central portion thereof a plurality of tools capable of moving radially inwardly and outwardly toward and away from one another while being rotated together about the axis of the annular frame. At the inlet side of the frame there is provided three infeed rolls of a construction which includes a multiplicity of conical spikes extending outwardly from a cylindrical periphery. The rolls are mounted on the annular frame for pivotal movement together toward and away from one another about axes which are parallel with the longitudinal axis of the annular frame. The rotational axis of each roll extends perpendicular to its pivotal axis. At the outfeed side of the annular frame there are provided three outfeed rolls of similar conical spike configuration mounted about the same pivotal axes as the infeed rolls and having their axes of rotation perpendicular to their pivotal axis. Each set of three rolls is normally spring urged into an innermost position and are movable outwardly in response to engagement of a log end therewith. As the infeed rolls move the log through the central portion of the annular frame, the tools are likewise moved away from one another. In operation, the tools are normally urged to move inwardly so as to press against the surface of the log being debarked with an intensity such that the tips penetrate the bark and continuously ride on the wood surface of the log despite irregularities of log contour and bark. A wood contacting edge of each tool tip is sufficiently blunt so as not to unduly damage the wood. As the leading end of the log moves into the outfeed side of the annular frame having been debarked, it engages the outfeed rollers which move apart to accommodate the periphery of the log and then serve to feed the log axially outwardly.

While the Brundell et al debarker has proven to be an effective piece of equipment in operation, one problem which is presented in the normal operation of the devices relates to the automatic conveying of the logs to the infeed mechanism of the debarker. Standard practice is to provide a deck for receiving the logs having a kick and hold mechanism or a stop and loading mechanism. These mechanisms serve to move successive logs onto a feeding conveyor which supports the logs and moves them into the infeed roll mechanism of the debarker machine. Typically a feeding conveyor is constructed of conical rolls although chain-trough type conveyors are used as well.

The feeding conveyors support the logs and move the same into the infeed rolls of the debarker machine automatically. A problem is sometimes presented when the log being fed by the feeding conveyor has an offset end. In the case of chain-trough type feeding this problem can be exaggerated when smaller logs are fed because of the greater possibility of the smaller logs being feed somewhat off-center. One type of malfunction which may occur when the leading end of the log is offset is simply that the offset end of the log is fed into abutting engagement with the surface of the annular frame facing in a direction opposed to the feed direction. When this happens the trailing end portion of the log continues to be moved in a feeding direction by the feeding conveyor resulting in the log being canted and ultimately broken with the attendant possibility of damage to the machine.

Conversely, when the offset is in the trailing end of the log, the initial feeding will take place in the usual way and as the offset end comes up to the infeed rolls, the extent of the offset may be such as to cause the infeed rolls to disengage with the result that the offset end is scraped by the annular frame by the operation of the outfeed rolls. Projections such as knots, limbs, catfaces and the like can engage the frame and cause log hang up and damage and possible machine damage.

An object of the present invention is to provide a mechanism for the infeed rolls of a debarking machine of the Brundell et al type which will obviate the problem conditions noted above. In accordance with the principles of the present invention this objective is obtained by providing cooperating helical feeding blades on opposite ends of each of the three rolls of the infeed roll system. Each feeding blade is shaped and positioned so as to cooperate with an adjacent feeding blade of an adjacent roll so as to engage the leading offset end of a log which may be fed to the debarking machine in offset relation by feeding conveyor. The cooperating blades act in a manner similar to the spikes in that as soon as an offset log end is engaged by two cooperating helical blades, the rolls are moved apart to engage the log periphery. The cooperating blades engaging the log periphery serve to move the offset end of the log transversely toward the axis of the annular frame until the spiked periphery of the associated rolls are engaged. The centered position of the trailing end of the log on the feeding conveyor results in the log progressively moving into a centered relation in engagement with all three rolls as it is moved through the annular frame and debarked by the rotating tools therein.

Another object of the present invention is the provision of a debarking machine having improved infeed rolls of the type described which machine is simple in construction, effective in operation and economical to manufacture and maintain.

These and other objects of the present invention will become more apparent during the course of the following detailed description and appended claims.

The invention may best be understood with reference to the accompanying drawings, wherein an illustrative embodiment is shown.

Figure 1:
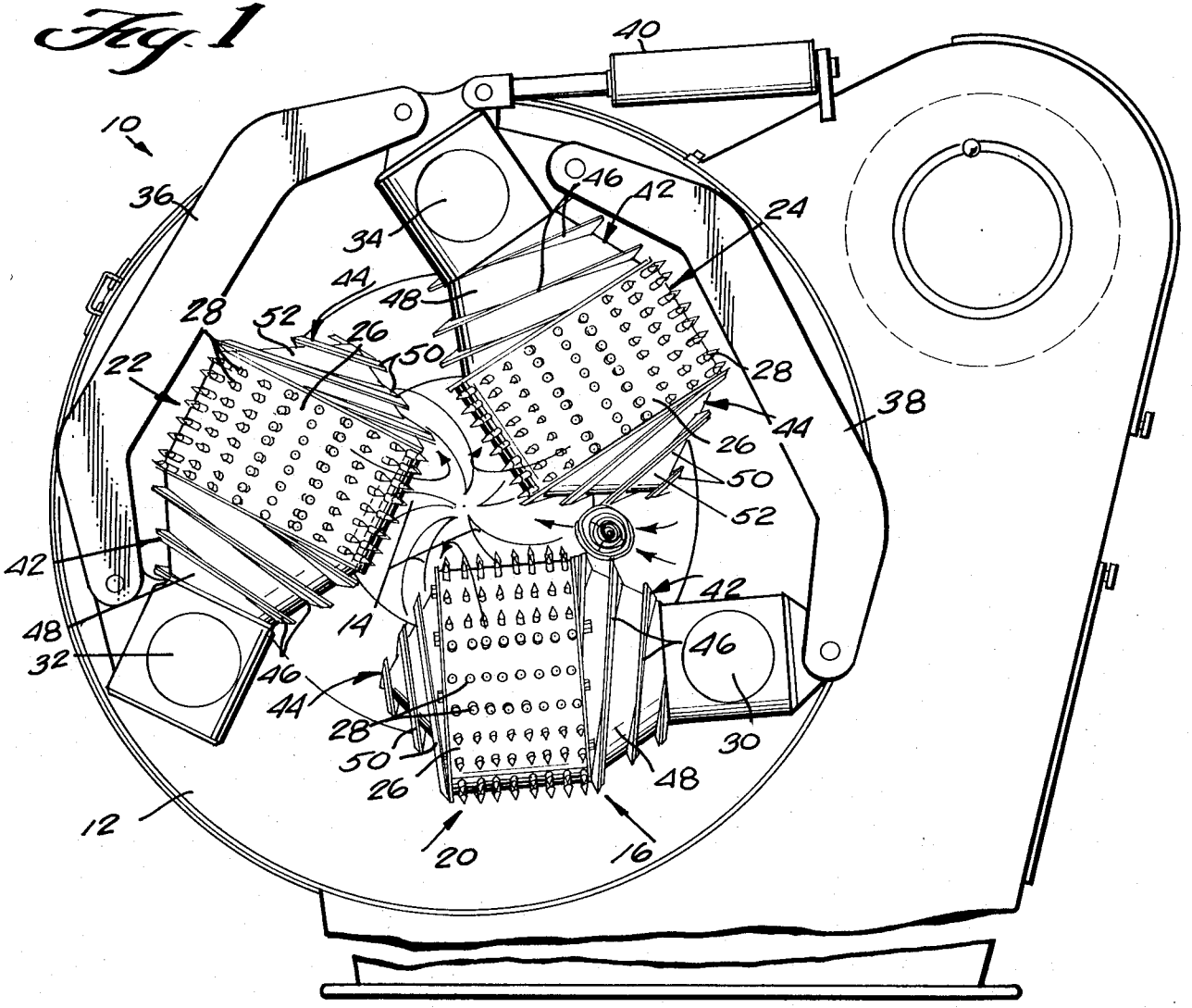
FIG. 1 is a front elevational view of a debarking machine provided with infeed rolls embodying the improvements of the present invention.
Figure 2:
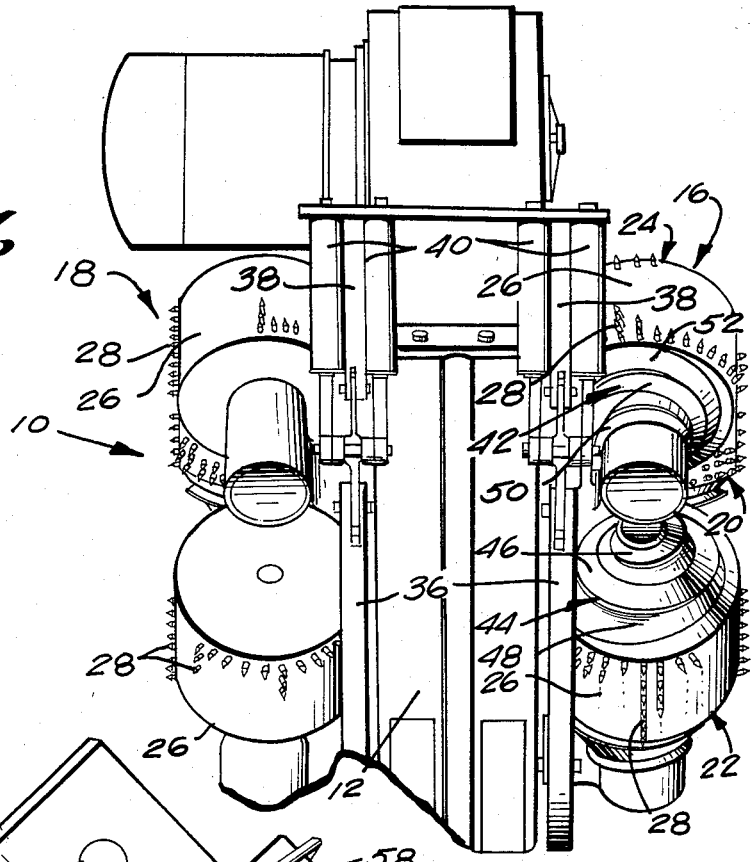
FIG. 2 is a side elevational view of the debarking machine shown in FIG. 1.

Referring now more particularly to FIGS. 1 and 2, there is shown therein a debarking machine, generally indicated at 10, which has embodied therein the improvements of the present invention. As previously indicated, the debarking machine is preferably of the type disclosed in commonly-assigned U.S. Pat. No. 2,857,945, the disclosure of which is hereby incorporated by reference into the present specification. Other related patents disclosing variations in the debarking machine include the following, the disclosure of each of which is hereby incorporated by reference into the present specification: U.S. Pat. Nos. 2,875,715; 2,860,672; 2,893,453; 2,903,027; 3,171,455; and 3,228,439.

The improvements of the present invention relate specifically to one of the basic components of the debarking machine and consequently the present specification will be concerned with the details of construction of the improvements and how they relate to the basic component in which they are embodied and how the improvements enhance the operative relationship between the improved components and the other basic components of the debarking machine. Consequently, the details of construction of the other components of the machine will not be specifically described, it being understood that reference may be had to any of the above-noted patents in order to obtain whatever detailed understanding is required.

The basic components of the debarking machine include an annular frame assembly, generally indicated at 12. Mounted within the annular frame assembly 12 for rotation together about the axis of the annular frame and for movement toward and away from each other is a plurality of annularly spaced debarking tools 14. The tools 14 are normally biased into their innermost position and are capable of moving outwardly in response to the engagement of a log end therewith so that the inner cutting ends of the tools will engage the periphery or bark of a log passing therethrough and remove the same as the tools are rotated together about the axis of the annular frame.

An infeed mechanism, generally indicated at 16, and an outfeed mechanism, generally indicated at 18, are provided on opposite sides of the annular frame assembly for feeding successive logs through the annular frame so that the tools will engage the exterior periphery of successive logs and strip the bark therefrom during their movement through the annular frame.

The outfeed mechanism 18 is similar in construction and operation with the infeed mechanism 16. The improvements of the present invention are embodied in the infeed mechanism 16 and consequently the details of construction of this mechanism will be recited with the understanding that the outfeed mechanism is similarly constructed except for the provision of the improvements of the present invention.

As shown in FIGS. 1 and 2 of the drawings, the infeed mechanism 16 includes three feed rolls, 20, 22 and 24. Each of the feed rolls is constructed similarly of a cylindrical member 26 having a multiplicity of spikes 28 suitably fixed to the exterior periphery thereof, as by welding or the like. As shown, the multiplicity of spikes 28 associated with each infeed roll cylinder 26 is positioned in annularly spaced transversely extending rows. As shown, each spike 28 is provided with a conical point. However, it will be understood that the spikes can be constructed in accordance with the teachings of my commonly-assigned application, Ser. No. 559,815, filed concurrently herewith, entitled "Feed Roll Spikes with Plus-shaped Cutting Edges". Moreover, the two upper infeed rolls 22 and 24 may be provided with transversely extending members which materially aid in accommodating lateral movement of the log when in engagement with the spikes in accordance with the teachings set forth in my commonly-assigned application, Ser. No 559,817 filed concurrently herewith, entitled "Debarking Machine with Feed Rolls Having Elongated Members Accommodating Lateral Movement".

It will be understood that each of the infeed rolls 20, 22 and 24 is power driven for rotational movement about the axis of the associated cylinder 26. In this regard it will be noted that the axes of the cylinders are disposed within a common plane which is perpendicular to the axis of the annular frame 12. Moreover, the three infeed rolls are positioned so that roll 20 has its axis disposed below the axis of the annular frame 12. The infeed roll 20 is power driven in a direction such that its upper periphery moves in a direction toward the tools 14 as indicated by the arrow shown in FIG. 1. The infeed rolls 22 and 24 are positioned in corresponding equally annularly spaced relation about the axis of the annular frame and each is power driven so that the spikes on the periphery thereof move inwardly toward the tools as they reach the closest position toward the axis of the annular frame. Stated differently, the three infeed rolls are power driven to rotate in a direction to cooperatively engage the periphery of a log and feed the same in a direction toward the tools 14 and through the annular frame 12 in generally coaxial relation therewith.

The infeed rolls 20, 22 and 24 are also mounted on the annular frame for simultaneous swinging movement about annularly spaced axes 30, 32 and 34 respectively, so that the cooperating log engaging spiked peripheries thereof will move toward and away from one another or toward and away from the axis of the annular frame 12. In order to effect simultaneous pivotal movement of the three infeed rolls, a pair of connecting links 36 and 38 is provided which extend respectively between the rolls 22 and 24, and rolls 24 and 20. In accordance with the teachings contained in the Brundell et al. patent, a pair of spring devices 40 is connected between the annular frame assembly 12 and the infeed roll 24 so as to resiliently bias roll 24 together with rolls 20 and 22 into their innermost positions with respect to one another.

As stated in the Brundell et al. patent, the operation of the infeed rolls is such that when a properly aligned log end is fed into engagement with the cooperating spiked peripheries of the infeed rolls 20, 22 and 24, the rolls move outwardly by a pivotal movement about axes 30, 32 and 34 against the resilient bias of spring assembly 40 by virtue of the engagement of the associated spikes 28 with the log end and the direction of power driven movement thereof. As the infeed rolls continue to rotate with the spikes 28 thereof in engagement with the bark or exterior periphery of the log, the log is moved along its axis in a direction toward the tools 14 and through the annular frame along its axis. As the log moves through the annular frame, tools 16 move outwardly and engage the bark or periphery of the log as it moves along its axis through the annular frame, thus removing the bark as the tools rotate together in engagement therewith. When the debarked end of the log engages the outfeed mechanism 18, the rolls thereof, which are power driven and operate similar to the infeed rolls, engage the log end and move outwardly and their continued rotational movement serves to feed the debarked log further along its axis until the entire log has been debarked by the tools 14 and moved away from the annular frame by the outfeed mechanism 18.

The improvements of the present invention relate to the provision of helical blade means 42 and 44 on the ends of each of the infeed rolls 20, 22 and 24. As previously indicated, the purpose of the helical blade means is to act upon the offset end of a log in situations where the extent of offset of the log end is such that it would not engage the periphery of any of the rolls 20, 22 or 24 when fed thereto by the automatic feeding equipment utilized with the debarking machine. Likewise, the helical blades 42 and 44 also serve to act upon an offset end of a log in situations where the offset is sufficient to cause the same to disengage from the spiked periphery of the infeed rolls during the feeding movement.

The helical blade means may assume any desired configuration capable of achieving the log handling functions hereinafter set forth. As shown, each helical blade means 42 is formed of two helical blades 46 displaced 180° with respect to one another, with each helical blade 46 having a constant pitch but with a radius which progressively increases from the outermost end of each blade to the innermost end thereof which is adjacent the peripheral spike. As shown, each helical blade 46 includes a continuous exterior periphery and a continuous interior periphery which is suitably fixed as by welding or the like to a frustoconical tube 48 whose major diameter is equal to the diameter of the associated cylindrical member 26 and is disposed in abutting relation therewith. In the specific embodiment disclosed each frustoconical tube 48 has a slope of approximately 30°.

The helical blade means 44 associated with each infeed roll likewise consists essentially of two helical blades 50 spaced apart 180°, each having the same pitch and each progressively increasing in diameter from the inner end to the outer end. As before, each helical blade 50 includes a continuous log engaging exterior periphery and has an inner periphery fixed, as by welding or the like, to a conical tube 52. As before, the conical tube 52 has its major diameter equal to and disposed in abutting relation with the adjacent edge of the associated cylindrical member 26. The slope of the conical member, as shown, is approximately 60° (included angle of approximately 120° ). It will be understood that the sets of helical blades 46 and 50 associated with each infeed roll are pitched in opposite directions interrelated with the direction of rotation of the associated roll so that a log engaged by the exterior periphery of a helical blade will be moved by continuous engagement with the helical blade in a direction toward the spiked periphery of the associated infeed roll.

Figure 3:
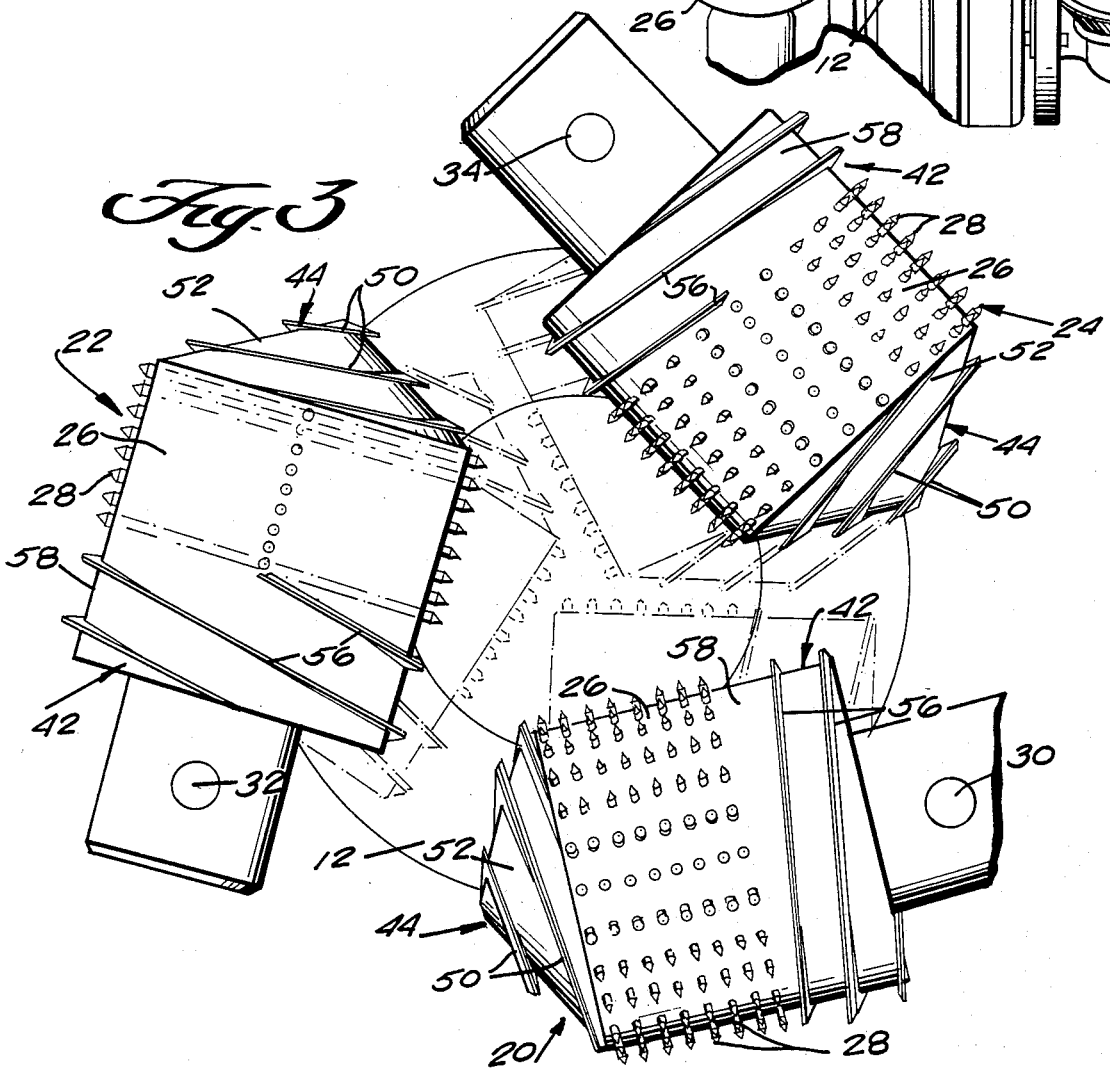
FIG. 3 is an enlarged fragmentary view similar to FIG. 1 illustrating infeed rolls having another form of the invention embodied therein.

FIG. 3 illustrates one possible modification of the helical blade means 42 of the present improvement. As shown, each helical blade means 42 is replaced by a helical blade means 54 comprising two 180° displaced helical blades 56 which are not only of constant pitch but of constant radius of curvature as well. As shown, the inner peripheries of the modified constant diameter helical blades 56 have their inner peripheries fixed, as by welding or the like, to a cylindrical tube 58 forming an extension of the associated cylindrical member 26.

It can be seen that when a log is fed to the debarking machine 10 embodying the improvements of the present invention, the machine 10 will function in its normal manner until such time as a log having a severe offset end is fed thereto. FIG. 1 illustrates a situation where the severely offset end of the log constitutes the leading end of the log being fed to the debarking machine 10. As shown, the offset end is spaced laterally from the axis of the annular frame 12 to an extent such that it is disposed out of engagement with the spiked periphery of the infeed rolls 20, 22 and 24. In the absence of the provision of the helical blade means improvements of the present invention, the end of the log as it is being fed from the automatic feeding system would pass outwardly of the infeed rolls and into abutting engagement with the annular frame. However, because of the provision of the helical blade means 42 and 44 on the ends of the infeed rolls, the end of the log will be engaged by the adjacent helical blades 46 and 50 before it reaches the annular frame 12. The engagement of the helical blades 46 and 50 with the end of the log causes the infeed rolls to move outwardly in the same fashion as would be the case where the leading end of the log is engaged by the spikes 28. The blades 46 and 50 which engage first the end of the log and then the periphery of the log, serve to move the log end laterally in a direction toward the axis of the annular frame in conjunction with its forward feeding movement. In this regard it will be noted that the log will be initially engaged by the continuous helical blades 46 and 50 and that during the aforesaid lateral movement of the log its periphery will engage the spikes 28 of the bottom infeed roll 20 before it has moved out of engagement with the helical blades 50 of the roll 24. The latter will continue to effect lateral movement of the log in conjunction with its feeding movement until the periphery of the log is also engaged by the spikes 28 of infeed roll 24. Depending upon the diameter size of the log, the log may continue its lateral movement until restrained and engaged by the spikes 28 of the other infeed roll 22. In this way logs having a leading offset end of an extent which normally would engage the annular frame and break during the feeding movement are handled in a manner which assures their lateral movement into feeding engagement with the infeed rolls so that the log will be moved through the tools and debarked in proper fashion.

It will also be understood that where the offset of the log is at the trailing end there will be a tendency for the spikes of the rolls 20, 22 and 24 which are in engagement therewith to maintain the centered relationship as the log is fed through the annular frame 12. However, the operation of the spikes 28 is such as to resist such movement, particularly when the spikes of all three rolls are in engagement with the periphery of the log. Nevertheless, it is possible for the trailing offset end to be of sufficient lateral extent that contact with the spikes 28 of one of the rolls is lost and lateral movement between the spikes of the other two rolls takes place to the extent such that the log moves laterally out of engagement with the spikes of all of the rolls. In this event, any tendency of the trailing offset end of the log to move laterally beyond the spiked periphery of the two rolls which previously engaged the same to an extent sufficient to contact the annular frame is prevented by virtue of the fact that the periphery of the log will be engaged by the cooperating helical blades 46 and 50 and thereby continuously urged to move back into engagement with the spiked periphery of the two rolls. The arrangement thus prevents a trailing offset log end from moving out of engagement with the spiked rolls to an extent such that it will be pulled through the frame by the outfeed mechanism 18 with the possibility that knots, limbs or other projecting portions could engage the annular frame and cause damage.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modification encompassed within the spirit and scope of the following claims.

What is claimed is:

1. In a debarking machine of the type including an annular frame, a plurality of debarking tools, means mounting said tools in annularly spaced relation within said annular frame for rotation together about the axis of said annular frame and for movement toward and away from each other, infeed and outfeed mechanisms for feeding logs through said annular frame so that said tools will engage the exterior periphery of the successive logs and strip the bark therefrom during their movement through the annular frame, said infeed mechanism including three driven infeed spiked rolls arranged so that their spiked peripheries normally engage the exterior periphery of the log in centered relation and move the same axially through said annular frame for debarking by said tools, the improvement which comprises:

said infeed mechanism including helical blade means at the ends of each roll for rotation therewith configured with respect to the direction of rotational movement of the associated roll to move a log engaged thereby in a lateral direction toward the spiked periphery of the roll.

2. The improvement as defined in claim 1 wherein the helical blade means at each end of each roll comprises a pair of helical blades of equal pitch displaced 180° with respect to one another, said helical blades having an exterior peripheral radius of curvature substantially equal to the radius of a cylinder touching the spike tips of the associated roll at the positions thereof adjacent the latter.

3. The improvement as defined in claim 2 wherein the radius of curvature of said helical blades progressively increases to said substantially equal value from a position remote from the spiked periphery of the associated roll.

4. The improvement as defined in claim 2 wherein the radius of curvature of said helical blades on at least one end of each roll is constant throughout its axial extent.

5. The improvement as defined in claim 2 wherein the interior periphery of each helical blade is fixed to a conically sloped wall of a tube.

6. The improvement as defined in claim 5 wherein said tube is frustoconical.

7. The improvement as defined in claim 5 wherein said tube is conical.

* * * * *